US006299471B1

(12) United States Patent
Hatagishi et al.

(10) Patent No.: US 6,299,471 B1
(45) Date of Patent: Oct. 9, 2001

(54) PRESS-CONNECTING CONNECTOR

(75) Inventors: Yuji Hatagishi; Kentaro Nagai, both of Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/398,416

(22) Filed: Sep. 17, 1999

(30) Foreign Application Priority Data

Nov. 10, 1998 (JP) ..... 10-319442

(51) Int. Cl.[7] ..... H01R 11/20
(52) U.S. Cl. ..... 439/397; 439/701
(58) Field of Search ..... 439/397–407, 439/465, 701, 687, 596

(56) References Cited

U.S. PATENT DOCUMENTS 5,683,272 * 11/1997 Abe ..... 439/747
6,027,374 * 2/2000 Nagai et al. ..... 439/596
6,083,056 * 7/2000 Okabe et al. ..... 439/701

* cited by examiner

*Primary Examiner*—Brian Sircus
*Assistant Examiner*—Son V. Nguyen
(74) *Attorney, Agent, or Firm*—Sughrue, Mion, Zinn, Macpeak & Seas, PLLC

(57) ABSTRACT

An insulating base plate 113 of a housing 11 includes an upper plate portion 114, a lower plate portion 115, and reinforcing plate portions 116 are formed on and extend between the upper and lower plate portions 114 and 115, and are disposed respectively at those portions of the upper and lower plate portions corresponding respectively to positions where wires of a wire harness W are press-connected to respective terminals. With this construction, the weight of the housing can be reduced because of the provision of hollow portions 117. And besides, since the reinforcing plate portions 116 are formed at those portions of the insulating base plate corresponding respectively to the positions where the wires of the wire harness W are press-connected to the respective terminals, the press-connecting operation can be carried out in a stable manner without flexing the insulating base plate 113. Therefore, the press-connecting metal terminals 13 will not be displaced upward and downward, and each wire of the wire harness W is prevented from being disposed out of alignment with the associated press-connecting metal terminal 13.

20 Claims, 6 Drawing Sheets

PRESS-CONNECTING CONNECTOR

BACKGROUND OF INVENTION

1. Field of the Invention

This invention relates to a press-connecting connector, and more particularly to a press-connecting connector with joint terminals, such as a connector for use with a wire harness and a connector used for connecting various electronic equipments.

2. Related art

One conventional press-connecting connector includes a housing as shown in FIG. 6. The housing 1 of this press-connecting connector includes a base plate 2, and a plurality of partition walls 3 are integrally formed perpendicularly on each of upper and lower surfaces of the base plate 2, and are spaced a predetermined distance from one another. A press-connecting terminal 4 is provided between any two adjacent partition walls 3. The press-connecting terminal 4 has a generally U-shaped cross-section, and includes pairs of opposed press-connecting blades 4A, each pair of blades 4A and 4A extending inwardly from opposed inner surfaces of the terminal 4, respectively. For connecting a wire harness W to the press-connecting terminals 4, each wire of the wire harness W is pressed against the associated press-connecting terminal 4 by a press-connecting punch 5 as shown in FIG. 7. When the wire of the wire harness W is thus pressed against the press-connecting terminal 4, each pair of press-connecting blades 4A and 4A cut a sheath of the wire of the wire harness W, and are brought into contact with a conductor of the wire. A cover (not shown) is attached to the housing 1 (to which the wire harness W is connected) to form the connector.

In the above conventional press-connecting connector, however, when connecting the wire harness W to the housing by the use of the press-connecting punch 5, the base plate 2 is flexed by a load, applied from the press-connecting punch 5, since this base plate 2 is thin as shown in FIG. 7, and this results in a problem that the press-connecting operation is unstable. If the thickness of the base plate 2 is increased as shown in FIG. 8 in order to overcome this problem, the amount of a synthetic resin, forming the housing 1, increases, and the degree of shrinkage after the molding is large. As a result, there are encountered problems that there occurs an error in the pitch of the arranged wires and that a sinkmark (recess) 6 is formed in the surface of the molded product.

If such a sink mark 6 develops, the wire press-connecting position varies in an upward-downward direction (indicated by arrow h in FIG. 9), thus inviting a problem that the connection reliability is lowered.

SUMMARY OF INVENTION

This invention has been made in view of the above problems, and an object of the invention is to provide a press-connecting connector in which any shrinkage and sink mark will not develop in a molded housing, and besides the wire press-connecting position is stable, thus achieving a high connection reliability.

According to a first aspect of the present invention, there is provided a press-connecting connector wherein press-connecting metal terminals, to which a plurality of wires are press-connected, respectively, are provided on each of opposite sides of an insulating base plate; provided in that the insulating base plate includes two base plate portions which are spaced a predetermined distance from each other, and define the opposite sides of the insulating base plate, respectively; and reinforcing plate portions are formed on and extend between the two base plate portions, and are disposed respectively at those portions of the two base plate portions corresponding respectively to positions where the wires are press-connected to the respective terminals.

In this invention, the reinforcing plate portions are formed at those portions of the insulating base plate at which the wires are press-connected to the respective terminals, and therefore in the wire press-connecting operation, the flexing of the insulating base plate is suppressed, and each wire is prevented from being disposed out of alignment with the associated press-connecting metal terminal.

In the press-connecting connector of a second aspect of the present invention according to the first aspect of present invention, the reinforcing portions are defined respectively by thickened portions of the insulating base plate in which a constituent material is densely present, the thickened portions extending over an entire width of the insulating base plate.

In this invention, the reinforcing portions are defined respectively by the thickened portions of the insulating base plate in which the constituent material is densely present, the thickened portions extending over the entire width of the insulating base plate, and therefore in addition to the effect of the invention of claim 1, the reinforcing plate portions reinforce the two base plate portions when the base plate portion is pressed, for example, by a press-connecting jig (press-connecting punch), thereby enabling the stable press-connecting operation.

In the press-connecting connector of a third aspect of present invention according to the first or second aspect, a hollow portion is formed between any two adjacent reinforcing plate portions.

In this invention, since the hollow portion is provided formed between any two adjacent reinforcing plate portions, the overall weight of the insulating base plate can be reduced.

In the press-connecting connector of the fourth aspect of the present invention according to the third aspect, the reinforcing plate portions, as well as the hollow portions, are formed continuously relative to the insulating base plate in a direction of extending of the wires.

In this invention, the reinforcing plate portions extend parallel to the hollow portions, and therefore the insulating base plate, when molded of a resin, can be easily removed from a mold.

In the press-connecting connector of the fifth aspect of the present invention according to the third or fourth aspect of the present invention, the cross-section of each hollow portion, disposed substantially perpendicular to the direction of extending of the wires, has one of a circular shape, an oval shape, a rectangular shape and a triangular shape.

In this invention, where the hollow portions have a circular cross-section or an oval cross-section, the insulating base plate has an increased strength in the direction of the thickness thereof. Where the hollow portions have a rectangular shape or a triangular shape, the overall rigidity of the insulating base plate is increased.

In the press-connecting connector of the sixth aspect of the present invention according to the first to fifth aspec to fht present invention, partition walls are formed perpendicularly on each of the opposite sides of the insulating base plate, and separate the press-connecting terminals from one another.

In this invention, the partition walls are provided, and therefore the wires can be arranged on the insulating base plate in insulating relation to one another.

DETAILED DESCRIPTION OF PREFERRED EMBODIMENTS

Figure 1:
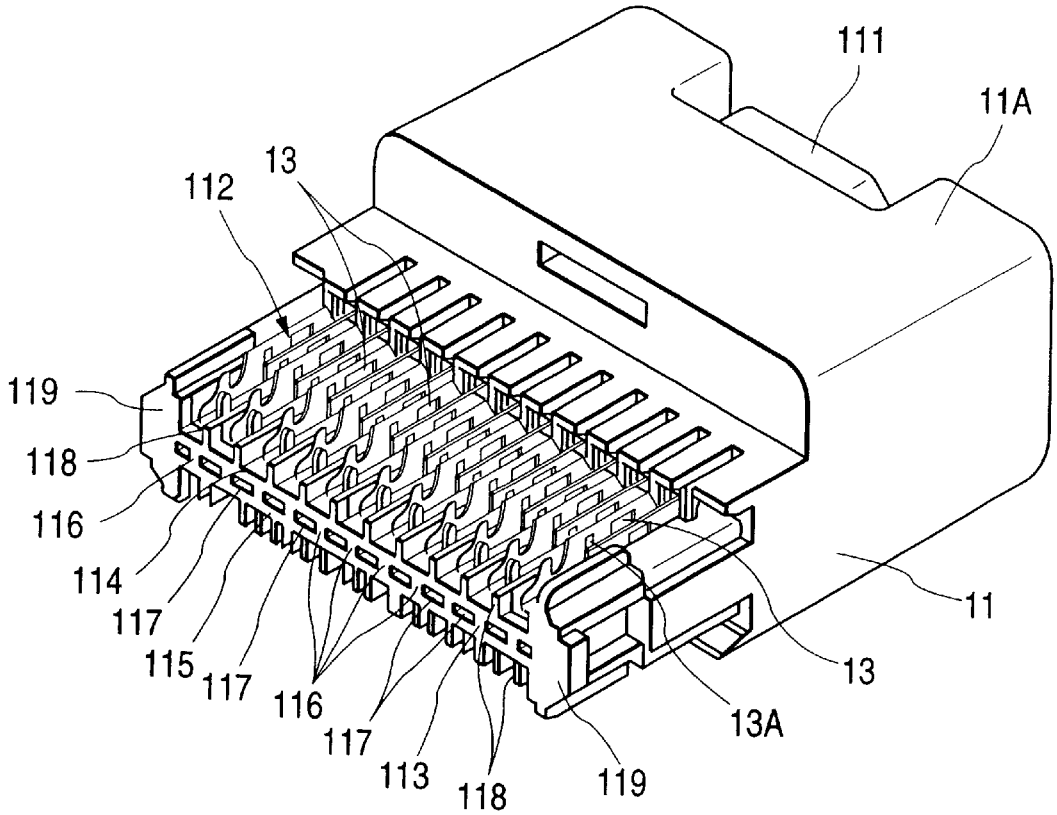
FIG. 1 is a perspective view showing an important portion of a preferred embodiment of a connector of the present invention.
Figure 2:
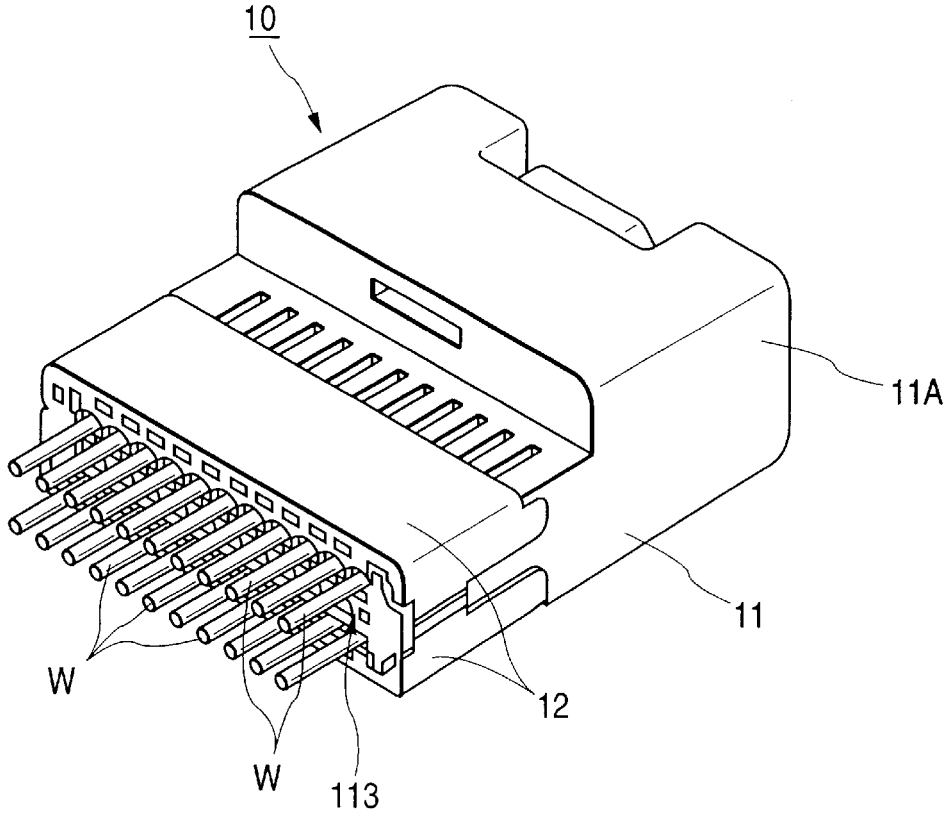
FIG. 2 is a perspective view showing the overall construction of the connector of the above embodiment.
Figure 3:
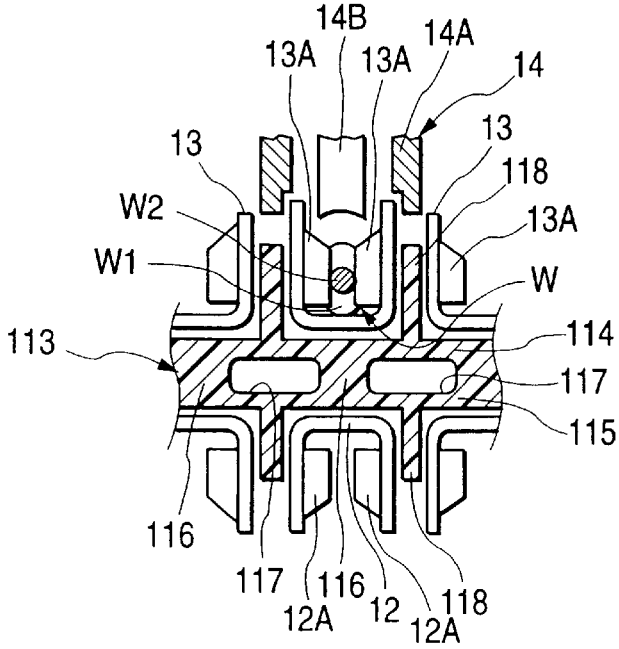
FIG. 3 is a cross-sectional view showing an important portion of the connector of the above embodiment.

A preferred embodiment of a press-connecting connector of the present invention will now be described in detail with reference to the drawings. FIG. 1 is a perspective view showing an important portion of the connector of this embodiment, FIG. 2 is a perspective view showing the overall construction of the connector, and FIG. 3 is a cross-sectional view showing an important portion of the connector. In this embodiment, the invention is applied to the female connector.

The press-connecting connector 10 of this embodiment broadly comprises a housing 11 and covers 12. The housing 11 has a socket portion 111 at its front end portion, and a connection portion 112 at its rear end portion, and a wire harness W is adapted to be connected to the connection portion 112. The housing 11 has an insulating base plate 113 of a generally rectangular shape formed over an entire region thereof. As shown in FIG. 2, the wire harness W is adapted to be held in position on opposite sides (faces) of the insulating base plate 113. The insulating base plate 113 includes a pair of upper and lower plate portions 114 and 115, spaced a predetermined distance from each other in an upward-downward direction, and a plurality of reinforcing plate portions 116 which are formed on and extend between the two plate portions 114 and 115, and are spaced at predetermined intervals. A hollow portion 117 of a rectangular cross-section is formed between any two adjacent reinforcing plate portions 116. The hollow portions 117 are formed through the insulating base plate 113, and extend continuously from a front end thereof to a rear end thereof. Partition walls 118 are formed on each of opposite sides (faces) of the insulating base plate 113 in such a manner that the partition wall 118 is disposed midway between any two adjacent reinforcing plate portions 116. Frame plates 119 are formed respectively on opposite side edges of the insulating base plate 113, and extend in the upward-downward direction.

As shown in FIGS. 1 and 3, a press-connecting metal terminal 13 of a generally U-shaped cross-section is provided in each of sections formed by the partition walls of the housing 11. The press-connecting metal terminal 13 has two pairs of opposed press-connecting blades 13A formed at a front end portion thereof. When a wire of the wire harness W is press-fitted into a gap between each pair of opposed press-connecting blades 13A, the press-connecting blades 13A cut a sheath W1 of the wire, and are brought into contact with a conductor W2 of the wire as shown in FIG. 3, thereby creating an electrical connection. In FIG. 3, reference numeral 14 denotes a press-connecting jig. The press-connecting jig 14 comprises a holder member 14A and a press-connecting punch 14B. In the press-connecting operation, the holder member 14A engages opposite outer side surfaces of the press-connecting metal terminal 13 to prevent this terminal 13 from spreading out.

A hood portion 11A is formed at the front end portion of the housing 11, and this hood portion 11A surrounds the insulating base plate 113, the partition walls 118 and the wire harness W. As shown in FIG. 2, the covers 12, made of an insulating synthetic resin, are attached to the rear end portion of the housing 11 to cover the exposed press-connecting metal terminals 13, thus forming the press-connecting connector 10.

As shown in FIG. 3, in the press-connecting connector 10 of this embodiment, the reinforcing plate portions 116, extending in the upward-downward direction, are formed respectively at those portions of the insulating base plate 113 corresponding respectively to those positions where the wires of the wire harness W is press-connected respectively to the press-connecting terminals 13. Therefore, when press-connecting the wire harness W by the press-connecting punch 14B, the reinforcing plate portions 116 perform a reinforcing function to prevent the insulating base plate 113 from being flexed. And besides, since the plurality of hollow portions 117 extend from the front end of the base plate 113 to the rear end thereof, the housing 11 can have a lightweight design.

Figure 4:
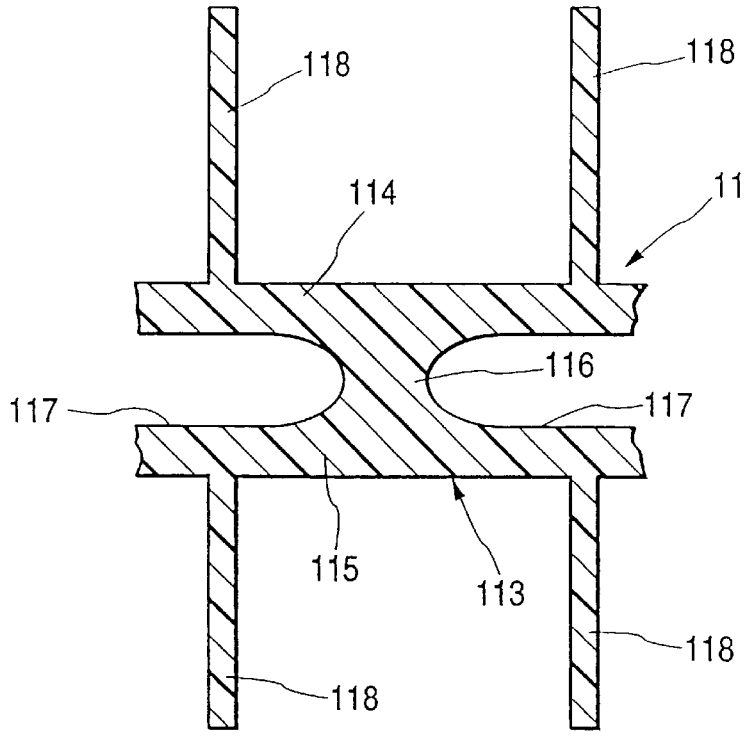
FIG. 4 is a cross-sectional view of an important portion of a modified press-connecting connector of the invention.
Figure 5A:
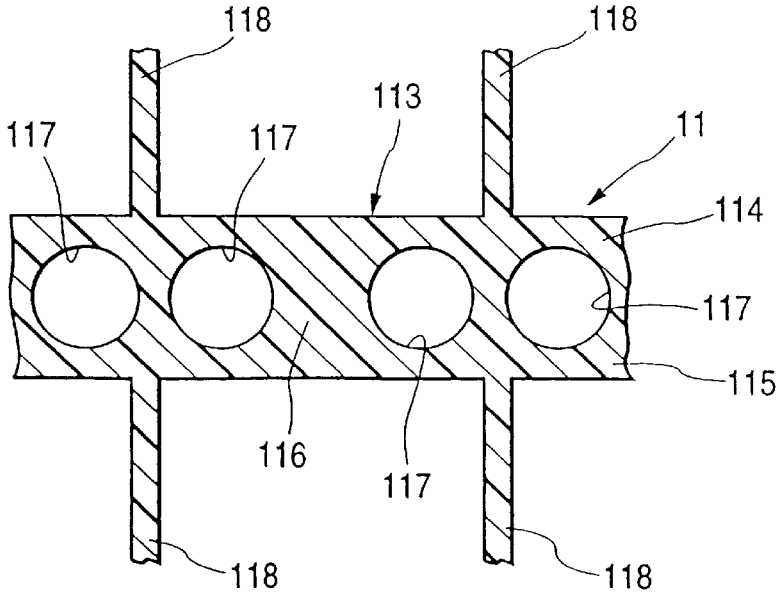
FIG. 5 is a cross-sectional view of an important portion of another modified press-connecting connector of the invention.
Figure 5B:
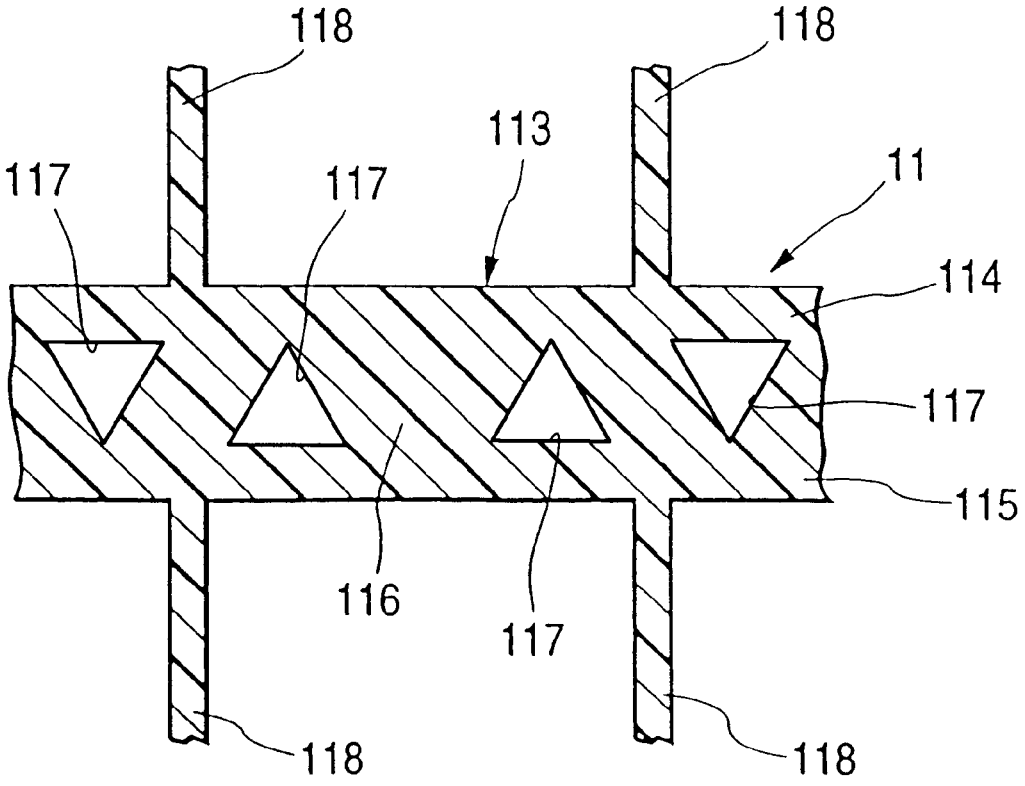
Figure 6:
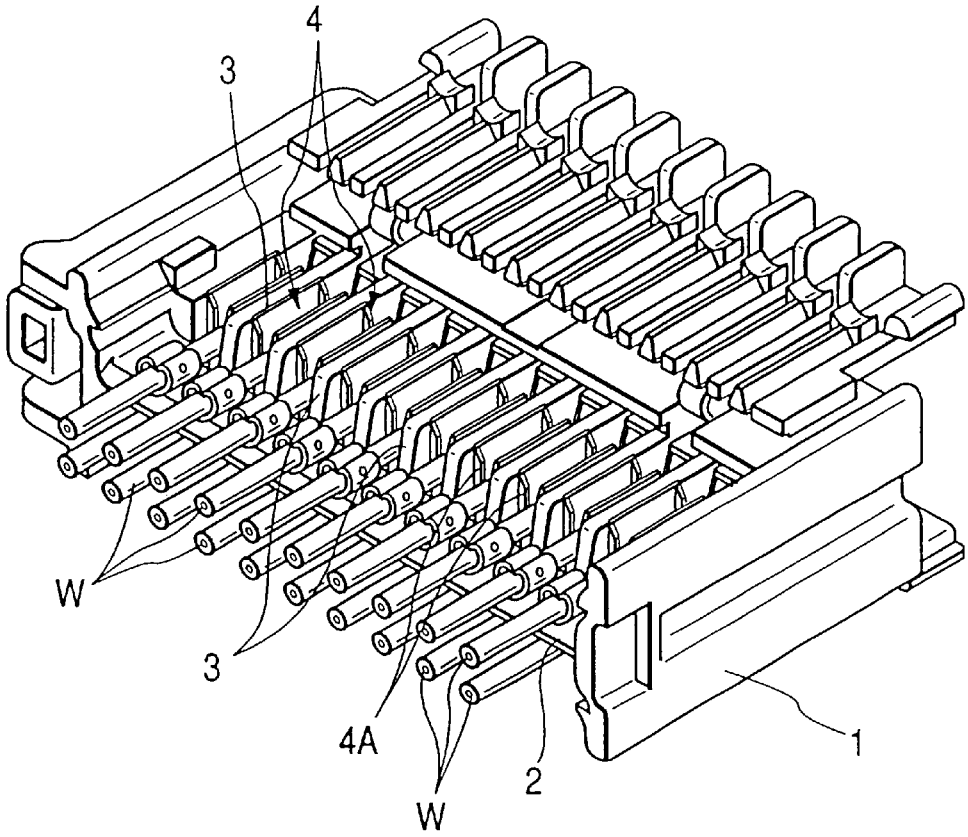
FIG. 6 PRIOR ART
FIG. 6 is a perspective view showing an important portion of a conventional press-connecting connector.
Figure 7:
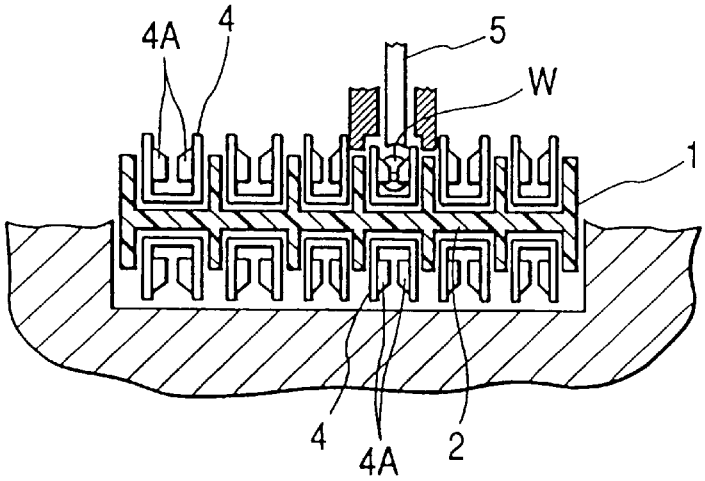
FIG. 7 PRIOR ART
FIG. 7 is a cross-sectional view of an important portion of the conventional press-connecting connector.
Figure 8:
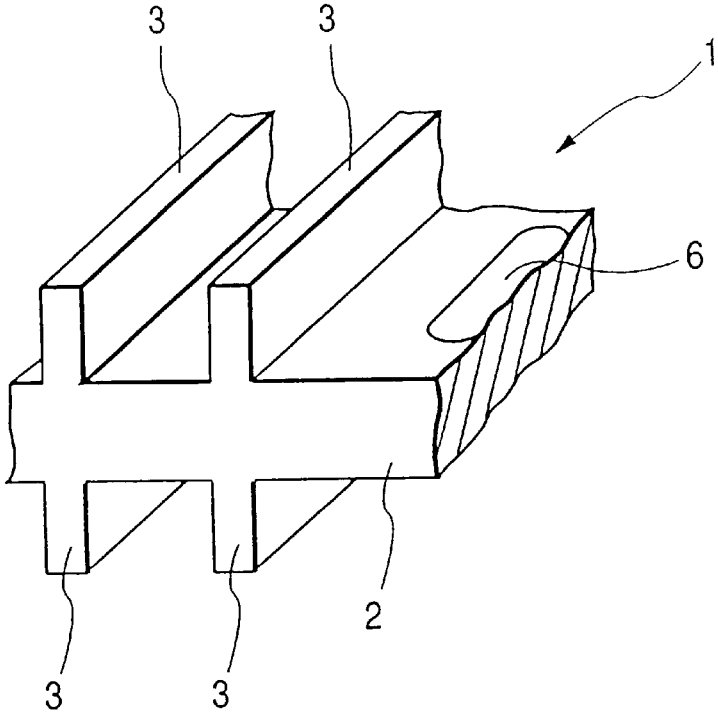
FIG. 8 PRIOR ART
FIG. 8 is a perspective view showing an important portion of a conventional press-connecting connector.
Figure 9:
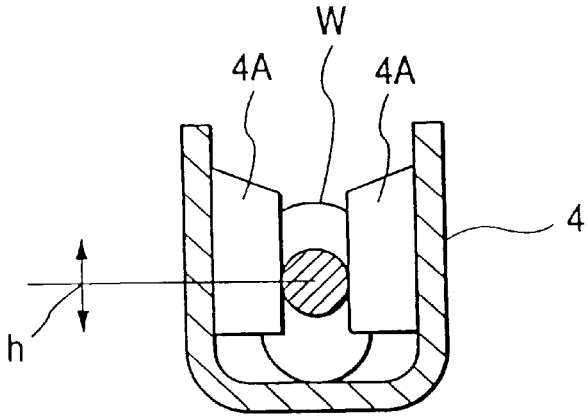
FIG. 9 PRIOR ART
FIG. 9 is a cross-sectional view of a press-connecting metal terminal mounted in the conventional press-connecting connector, showing the positional relation between this terminal and a wire of a wire harness.

Although the female connector, embodying the present invention, has been described, the present invention is not limited to this embodiment, but various modifications can be made within the scope of the invention. For example, although the hollow portions 117 of a rectangular cross-section are formed in the insulating base plate 113, the hollow portions may have a circular cross-section, an oval cross-section or a triangular cross-section. FIG. 4 shows a modified housing 11 in which hollow portions 117 of an oval cross-section are formed. In this modification, the long axis of each oval hollow portion 117 extends in the direction of the width of the insulating base plate 113. In this example, each reinforcing plate portion 116, formed between the hollow portions 117, is thicker at its upper and lower portions than at its intermediate portion, and therefore has an increased strength withstanding pressures applied in the upward and downward directions. FIG. 5 shows another modified housing 11 in which two hollow portions 117 of a circular cross-section are formed between any two adjacent reinforcing plate portions 116. This modification has an advantage that those portions of the insulating base plate, on which the partition walls 118 are formed, are reinforced.

As is clear from the foregoing description, in the first aspect of the invention, the reinforcing plate portions are formed at those portions of the insulating base plate at which the wires are press-connected to the respective terminals, and therefore in the wire press-connecting operation, the flexing of the insulating base plate is suppressed, and each wire is prevented from being disposed out of alignment with the associated press-connecting metal terminal.

In the second aspect of the invention, in addition to the effect of the first aspect of invention, the reinforcing plate portions reinforce the two base plate portions when the base plate portion is pressed, for example, by the press-connecting jig (press-connecting punch), thereby enabling the stable press-connecting operation.

In the third aspect of the invention, the hollow portion is provided formed between any two adjacent reinforcing plate portions, and therefore in addition to the effects of the first or second aspect of the invention, there is achieved an advantage that the overall weight of the insulating base plate can be reduced.

In the fourth aspect of the invention, the reinforcing plate portions extend parallel to the hollow portions, and therefore in addition to the effect of third aspect of the invention, there is achieved an advantage that the insulating base plate, when molded of a resin, can be easily removed from a mold.

In the fifth aspect of the fifth aspect of the invention, the effects of the third or fourth aspect of the invention are achieved, and in addition, where the hollow portions have a circular cross-section or an oval cross-section, the insulating base plate has an increased strength in the direction of the thickness thereof. Where the hollow portions have a rectangular shape or a triangular shape, the overall rigidity of the insulating base plate is increased.

In the sixth aspect of the invention, the partition walls are provided, and therefore in addition to the effects of the first to fifth aspects of the invention, there is achieved an advantage that the wires can be arranged on the insulating base plate in insulating relation to one another.

What is claimed is:

1. A press-connecting connector comprising:

press-connecting metal terminals to which a plurality of wires are press-connected, respectively;

an insulating base plate, said press-connecting metal terminals being provided on each of opposite sides of said insulating base plate, and said insulating base plate includes two base plate portions which are spaced a predetermined distance from each other, and define said opposite sides of said insulating base plate, respectively; and reinforcing plate portions which are formed on and extend between said two base plate portions, wherein said reinforcing plate portions are disposed respectively at all locations along said two base plate portions which correspond respectively to positions where said wires are press-connected to the respective terminals.

2. A press-connecting connector according to claim 1, wherein said reinforcing portions are defined respectively by thickened portions of said insulating base plate in which a constituent material is densely present, said thickened portions extending over an entire width of said insulating base plate.

3. A press-connecting connector according to claim 1, wherein a hollow portion is formed between any two adjacent reinforcing plate portions.

4. A press-connecting connector according to claim 2, wherein a hollow portion is formed between any two adjacent reinforcing plate portions.

5. A press-connecting connector according to claim 3, wherein said reinforcing plate portions, as well as said hollow portions, are formed continuously relative to said insulating base plate in a direction of extending of said wires.

6. A press-connecting connector according to claim 4, wherein said reinforcing plate portions, as well as said hollow portions, are formed continuously relative to said insulating base plate in a direction of extending of said wires.

7. A press-connecting connector according to claim 3, wherein the cross-section of each hollow portion, disposed substantially perpendicular to the direction of extending of said wires, has one of a circular shape, an oval shape, a rectangular shape and a triangular shape.

8. A press-connecting connector according to claim 4, wherein the cross-section of each hollow portion, disposed substantially perpendicular to the direction of extending of said wires, has one of a circular shape, an oval shape, a rectangular shape and a triangular shape.

9. A press-connecting connector according to claim 5, wherein the cross-section of each hollow portion, disposed substantially perpendicular to the direction of extending of said wires, has one of a circular shape, an oval shape, a rectangular shape and a triangular shape.

10. A press-connecting connector according to claim 6, wherein the cross-section of each hollow portion, disposed substantially perpendicular to the direction of extending of said wires, has one of a circular shape, an oval shape, a rectangular shape and a triangular shape.

11. A press-connecting connector according to claim 1, wherein said insulating base plate has partition walls which are formed perpendicularly on each of said opposite sides of said insulating base plate, and separate said press-connecting terminals from one another.

12. A press-connecting connector according to claim 2, wherein said insulating base plate has partition walls which are formed perpendicularly on each of said opposite sides of said insulating base plate, and separate said press-connecting terminals from one another.

13. A press-connecting connector according to claim 3, wherein said insulating base plate has partition walls which are formed perpendicularly on each of said opposite sides of said insulating base plate, and separate said press-connecting terminals from one another.

14. A press-connecting connector according to claim 4, wherein said insulating base plate has partition walls which are formed perpendicularly on each of said opposite sides of said insulating base plate, and separate said press-connecting terminals from one another.

15. A press-connecting connector according to claim 5, wherein said insulating base plate has partition walls which are formed perpendicularly on each of said opposite sides of said insulating base plate, and separate said press-connecting terminals from one another.

16. A press-connecting connector according to claim 6, wherein said insulating base plate has partition walls which are formed perpendicularly on each of said opposite sides of said insulating base plate, and separate said press-connecting terminals from one another.

17. A press-connecting connector according to claim 7, wherein said insulating base plate has partition walls which are formed perpendicularly on each of said opposite sides of said insulating base plate, and separate said press-connecting terminals from one another.

18. A press-connecting connector according to claim 8, wherein said insulating base plate has partition walls which are formed perpendicularly on each of said opposite sides of said insulating base plate, and separate said press-connecting terminals from one another.

19. A press-connecting connector according to claim 9, wherein said insulating base plate has partition walls which are formed perpendicularly on each of said opposite sides of said insulating base plate, and separate said press-connecting terminals from one another.

20. A press-connecting connector according to claim 10, wherein said insulating base plate has partition walls which are formed perpendicularly on each of said opposite sides of said insulating base plate, and separate said press-connecting terminals from one another.

* * * * *